US008192515B2

(12) United States Patent
Conrad

(10) Patent No.: US 8,192,515 B2
(45) Date of Patent: Jun. 5, 2012

(54) CYCLONE SEPARATOR ASSEMBLY AND SURFACE CLEANING APPARATUS HAVING SAME

(75) Inventor: Wayne Ernest Conrad, Hampton (CA)

(73) Assignee: G.B.D. Corp, Nassau (BS)

( * ) Notice: Subject to any disclaimer, the term of this patent is extended or adjusted under 35 U.S.C. 154(b) by 818 days.

(21) Appl. No.: 12/337,935

(22) Filed: Dec. 18, 2008

(65) Prior Publication Data

US 2009/0181841 A1 Jul. 16, 2009

Related U.S. Application Data

(60) Provisional application No. 61/014,983, filed on Dec. 19, 2007.

(51) Int. Cl.
*A47L 9/16* (2006.01)

(52) U.S. Cl. ..... 55/345; 55/459.1; 15/347; 15/353

(58) Field of Classification Search ..... 15/347, 15/353; 55/345, 459.1
See application file for complete search history.

(56) References Cited

U.S. PATENT DOCUMENTS

| | | | | |
|---|---|---|---|---|
| 4,373,228 | A | 2/1983 | Dyson | |
| 6,406,505 | B1 | 6/2002 | Oh et al. | |
| 6,432,154 | B2 | 8/2002 | Oh et al. | |
| 6,532,620 | B2 | 3/2003 | Oh | |
| 7,086,119 | B2 | 8/2006 | Go et al. | |
| 7,160,346 | B2 | 1/2007 | Park | |
| 7,941,895 | B2 * | 5/2011 | Conrad | 15/353 |
| 8,034,140 | B2 * | 10/2011 | Conrad | 55/345 |
| 2007/0289267 | A1 | 12/2007 | Makarov et al. | |
| 2009/0205161 | A1 * | 8/2009 | Conrad | 15/353 |
| 2009/0209403 | A1 * | 8/2009 | Conrad | 15/353 |

FOREIGN PATENT DOCUMENTS

| | | | |
|---|---|---|---|
| CA | 2438079 | A1 | 1/2001 |
| WO | WO 2009076773 | A1 * | 6/2009 |

OTHER PUBLICATIONS

International Preliminary Report on Patentability for PCT/CA2008/002257—dated Apr. 14, 2009.*
International Search Report received on the corresponding International Patent Application No. PCT/CA2008/002257, dated Apr. 14, 2009.

* cited by examiner

*Primary Examiner* — David A Reifsnyder
(74) *Attorney, Agent, or Firm* — Bereskin & Parr LLP/S.E.N.C.R.L., s.r.l.; Philip C. Mendes da Costa

(57) ABSTRACT

A cyclone separator assembly comprises at least one cyclone casing defining a cyclone chamber. The cyclone casing comprises a fluid inlet, a separated material outlet, and a fluid outlet. A separated material chamber is in communication with the separated material outlet. The cyclone chamber is openable by movement of a first movable portion, and the separated material chamber is openable by movement of a second movable portion separate from the first movable portion. A surface cleaning apparatus utilizing this construction is also provided. This construction is particularly useable if the separated material chamber is aligned with and below the cyclone chamber. Accordingly, the cyclone chamber and the separated material chamber may be sequentially or concurrently opened.

24 Claims, 13 Drawing Sheets

CYCLONE SEPARATOR ASSEMBLY AND SURFACE CLEANING APPARATUS HAVING SAME

FIELD

This application relates to a cyclonic separator assembly that has two openable portions. In a preferred embodiment, the invention relates to a cyclonic separator assembly, or a plurality of cyclonic separator assemblies in parallel, utilized as a cleaning stage in a surface cleaning apparatus such as a vacuum cleaner.

BACKGROUND

Cyclonic separators, including those used in vacuum cleaners are known in the art. Typically, a cyclonic separator has an inlet for fluid (air, liquid or and air and liquid mix) to be treated and an outlet for treated fluid. Dirt may be collected either in the cyclone chamber itself (e.g. in the bottom) or in a collection chamber in fluid communication with the cyclone separator. Various such constructions are known in the art.

U.S. Pat. No. 7,086,119 (Go et al) discloses a dust-collecting unit for a vacuum cleaner. The dust-collecting unit includes a cyclone separator having a dirt collection chamber positioned adjacent one lateral side of the cyclone separator. A dirt outlet is provided in the upper wall of the cyclone such that dirt may enter the adjacent dirt collection chamber through the outlet in the upper wall of the cyclone separator. A second dirt collection chamber is positioned below the cyclone chamber and is accessed by an opening formed in a separating plate that separates the cyclone chamber and the second dirt collection chamber. An openable bottom is provided. However, when the bottom is opened, the cyclone chamber is still closed by the separating plate.

U.S. Pat. No. 7,160,346 (Park) discloses a cyclone for use in a vacuum cleaner having a dirt collection space positioned below the cyclone chamber. A dirt outlet is provided as an annular gap between the sidewall of the cyclone chamber and a separating plate for permitting dirt to travel downwardly from the cyclone into the dirt collection chamber. Accordingly, the dirt collection chamber is not exterior to the cyclone casing but is within the casing.

SUMMARY

If the cyclone separator assembly comprising a cyclone chamber and a dirt collection chamber is used in a household appliance, such as a vacuum cleaner or air cleaner, from time to time, a consumer will have to empty the interior of both the cyclone chamber and the dirt collection chamber. For example, hair and fluff may become trapped in the cyclone chamber and not be conveyed to the dirt collection chamber. In some constructions, the dirt collection chamber is axially displaced from the cyclone chamber (e.g., above or below the cyclone chamber in the direction of the longitudinal axis of the cyclone chamber). In accordance with this invention, an improved emptying mechanism is provided such that a consumer may open both the dirt collection chamber and the cyclone chamber for emptying.

According to one broad aspect, a cyclone separator assembly is provided. The cyclone separator assembly comprises at least one cyclone casing defining a cyclone chamber. The cyclone casing comprises a fluid inlet, a separated material outlet, and a fluid outlet. A separated material chamber is in communication with the separated material outlet. The cyclone chamber is openable by movement of a first movable portion, and the separated material chamber is openable by movement of a second movable portion. The first movably portion is separate from the second movable portion.

Embodiments in accordance with this broad aspect may be advantageous because the cyclone chamber and the separated material chamber may be individually emptied. For example, a user may open the separated material chamber to empty material that has accumulated therein, and may then open the cyclone chamber to empty material that may be causing a blockage.

In some embodiments, each cyclone chamber and each separated material chamber is pivotally openable.

In some embodiments, the at least one cyclone comprises a plurality of cyclones in parallel.

In some embodiments, each cyclone is in communication with a common separated material collection chamber. In other embodiments, a plurality of separated material chambers are provided, and each cyclone is in communication with one of the separated material chambers.

In some embodiments, each cyclone chamber has a first end and a spaced apart second end, and each separated material chamber has a dirt collection surface facing the second end and spaced from the second end. The first movable portion may comprise the first end, and the second movable portion may comprise the dirt collection surface.

In some embodiments, the fluid inlet may be provided at the first end, and the fluid inlet comprises part of the first movable portion. Alternately, or in addition, the fluid outlet may be provided at the first end, and the fluid outlet comprises part of the first movable portion. In either embodiment, the separated material outlet may be provided at the second end.

In some embodiments, a sidewall extends between the first end and the second end of each cyclone, and the first movable portion further comprises at least a portion of the sidewall.

In some embodiments, the first movable portions of the cyclones are integrally formed and/or the second moveable portions are integrally formed.

In some embodiments, the separated material chambers may comprise a collection chamber casing and an openable end panel.

In some embodiments, the first and second movable portions may be mounted to the collection chamber casing.

In some embodiments, the first movable portion and the second movably portion may be pivotally mounted to the collection chamber casing.

In some embodiments, the first movable portion may comprise an upper portion of each cyclone casing, and a lower portion of each cyclone casing may be formed by the collection chamber casing.

In some embodiments, each cyclone chamber and each separated material chamber may be pivotally openable.

According to another broad aspect, a surface cleaning apparatus comprising one or more cyclone separator of any embodiment is provided. In some embodiments, the cyclone separator may comprise a second cyclonic cleaning stage of the surface cleaning apparatus. In some embodiments, a plurality of the cyclone separator may be connected in parallel to provide the second cyclonic cleaning stage.

DETAILED DESCRIPTION

Figure 13:
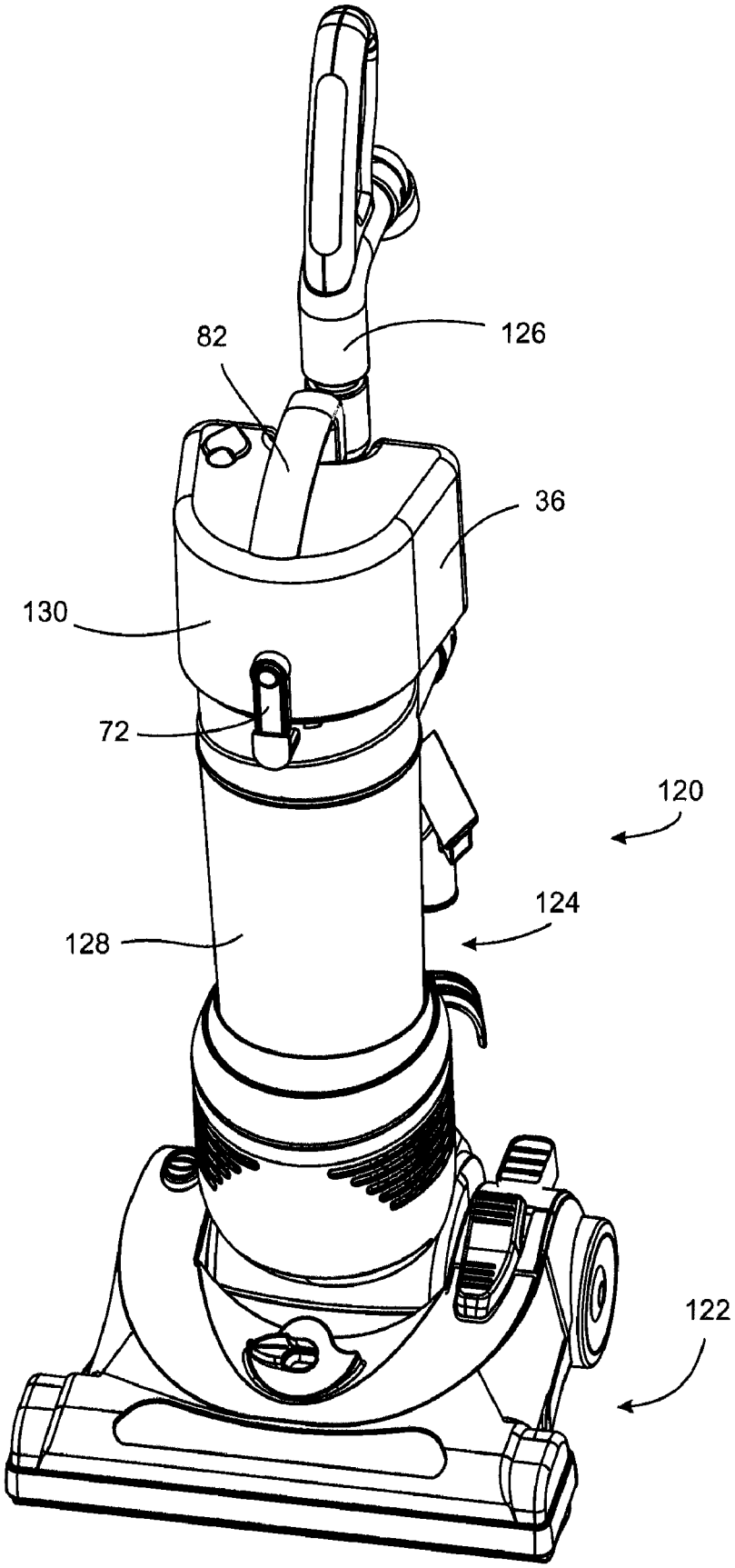

In the following description of the preferred embodiment, the cyclone separator is described as used in a vacuum cleaner of any particular design. As exemplified in FIG. 13, surface cleaning apparatus 120 may be an upright vacuum cleaner having a surface cleaning head 122 and a vacuum cleaner body 124 pivotally mounted thereto. Handle 126 may be provided for moving surface cleaning apparatus 120. Surface cleaning apparatus 120 has a first cyclonic cleaning stage 128 and a second cyclonic cleaning stage 130. However, it will be appreciated that the description set out herein is not confined to such uses as may be used for any other application referred to herein or known in the art.

FIGS. 1-6 exemplify a preferred embodiment wherein cyclone separator assembly 1 comprises a plurality of cyclones 10. Preferably, the plurality of cyclones 10 is provided in parallel. As will be described further herein, more preferably, the plurality of cyclones 10 is provided as second cleaning stage 130, more preferably a second cyclonic cleaning stage and most preferably a second cyclonic cleaning stage of parallel cyclones in a surface cleaning apparatus.

As shown, the cyclone assembly 1 comprises six cyclones 10. In alternate embodiments, another number of cyclone separator apparatus 10 may be provided. For example, the cyclone assembly 1 may include only a single cyclone, or more than six cyclones.

As exemplified in FIGS. 1-6, cyclone separator assembly 1 is in an upright configuration. Alternately, the cyclone separator assembly 1 may be inverted.

In the embodiment shown, each cyclone 10 comprises a cyclone casing 40, which defines a cyclone chamber 26. Each cyclone chamber 26 has a sidewall 12, a first end 14, a second end 16, an air inlet 18, an air outlet 20, an optional transition member 22 and a dirt (or separated material) outlet 24. As exemplified, the upper portions of the cyclone casings 40 are integrally formed from a common upper casing 92 of the assembly 1. Upper casing comprises the air inlet 18, the air outlet 20, and a portion or all of the sidewalls 12. A portion of the sidewall 12, the optional transition member 22 and a dirt (or separated material) outlet 24 of each cyclone are integrally formed as part of lower casing 96.

First 14 and second ends 16 of each cyclone 10 are spaced apart and are positioned opposite each other. Preferably, as exemplified, each air inlet 18 is provided in sidewall 12 and, more preferably, adjacent first or upper end 14. In addition, each air outlet 20 is preferably provided in upper first end 14 and, preferably, is centrally located therein. Accordingly, air entering the cyclone 10 will travel in a cyclonic fashion downwardly towards second end 16. Heavier material, e.g. particulate material, will exit cyclone chamber 26 via separated material outlet 24. The air at some point reverses direction and travels upwardly through outlet 20 to exit cyclone chamber 26.

Figure 2:
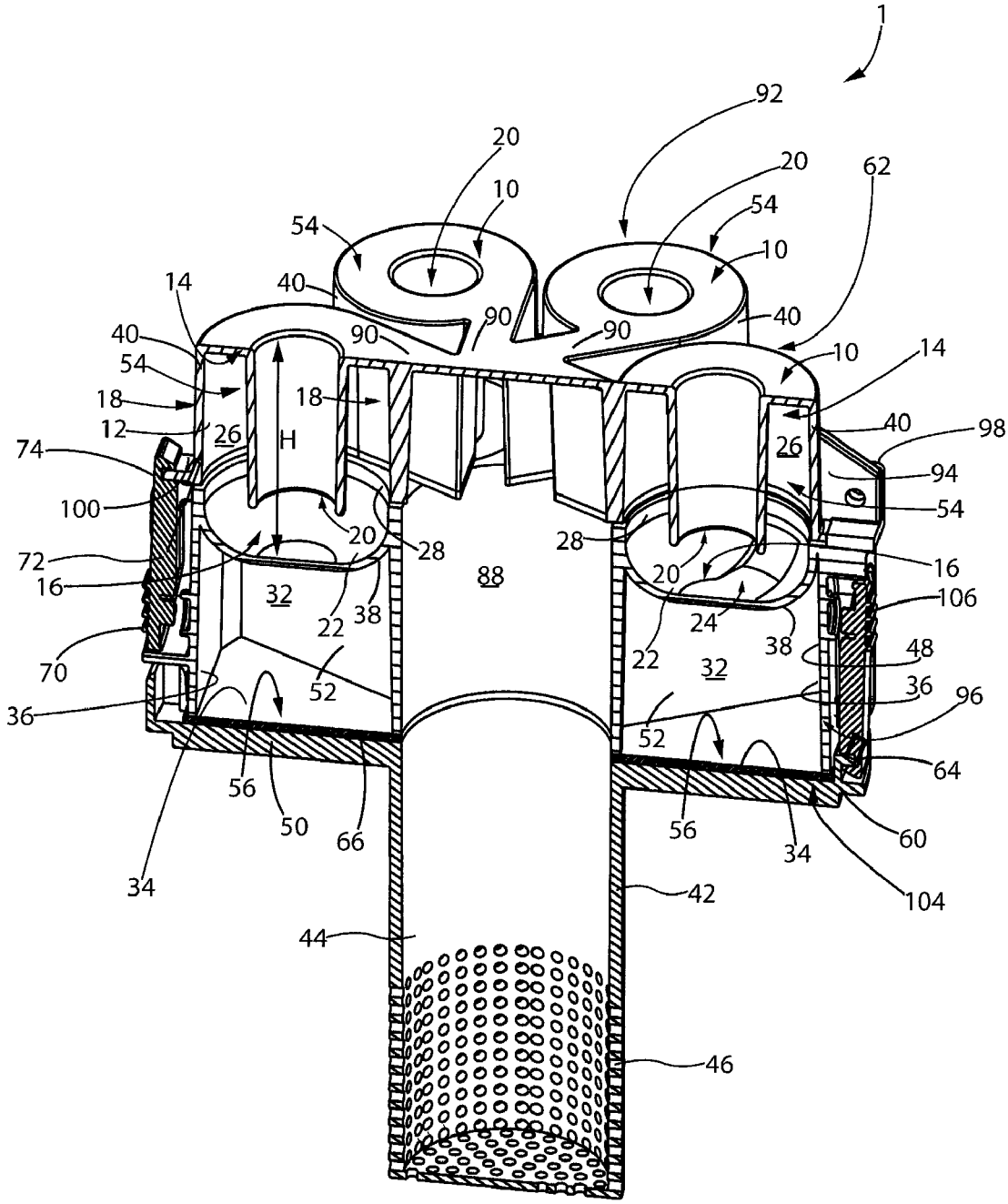
FIG. 2 is a cross section taken along line 2-2 in FIG. 1.
Figure 3:
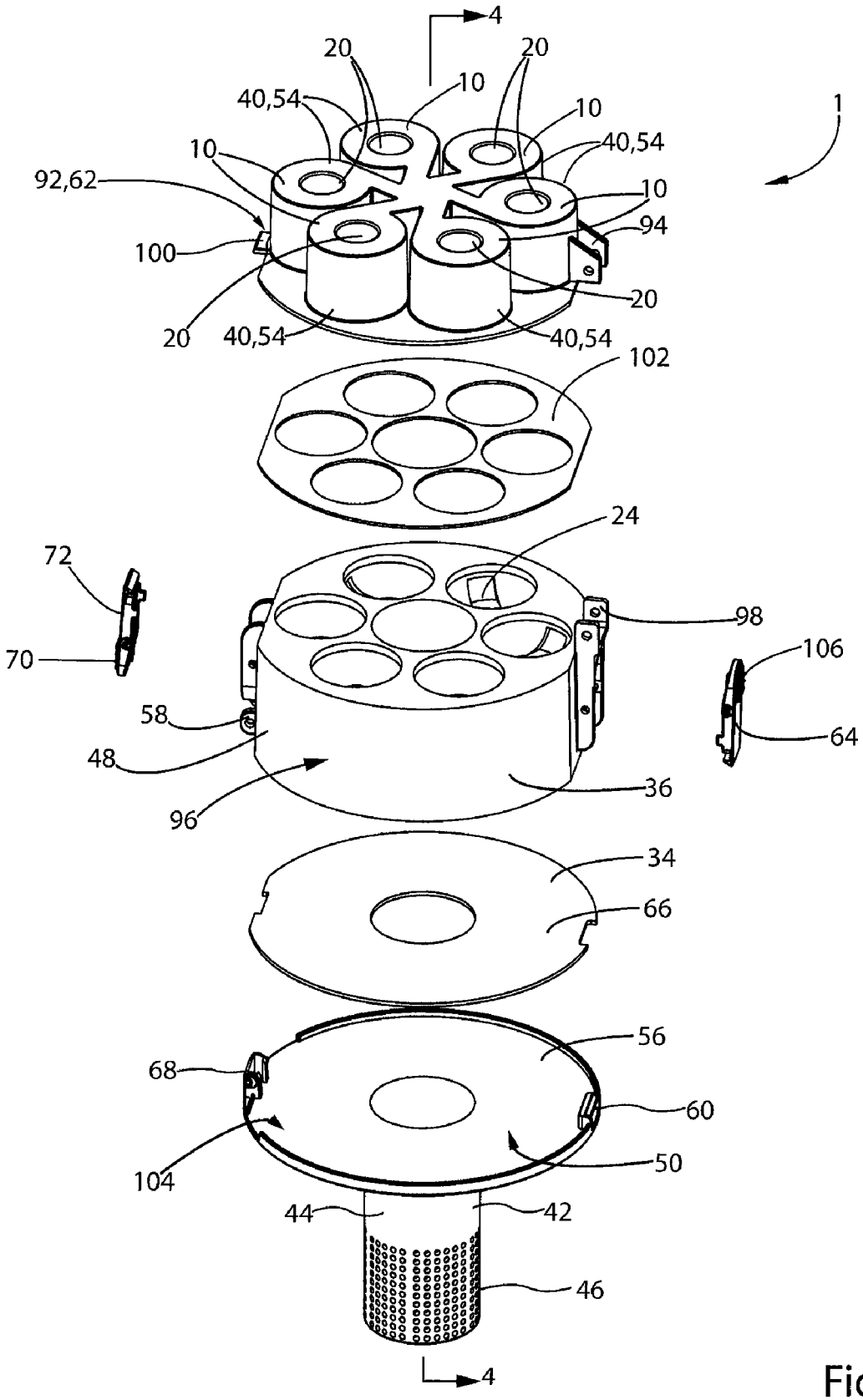
FIG. 3 is an exploded view of the cyclone separator assembly of FIG. 1.
Figure 4:
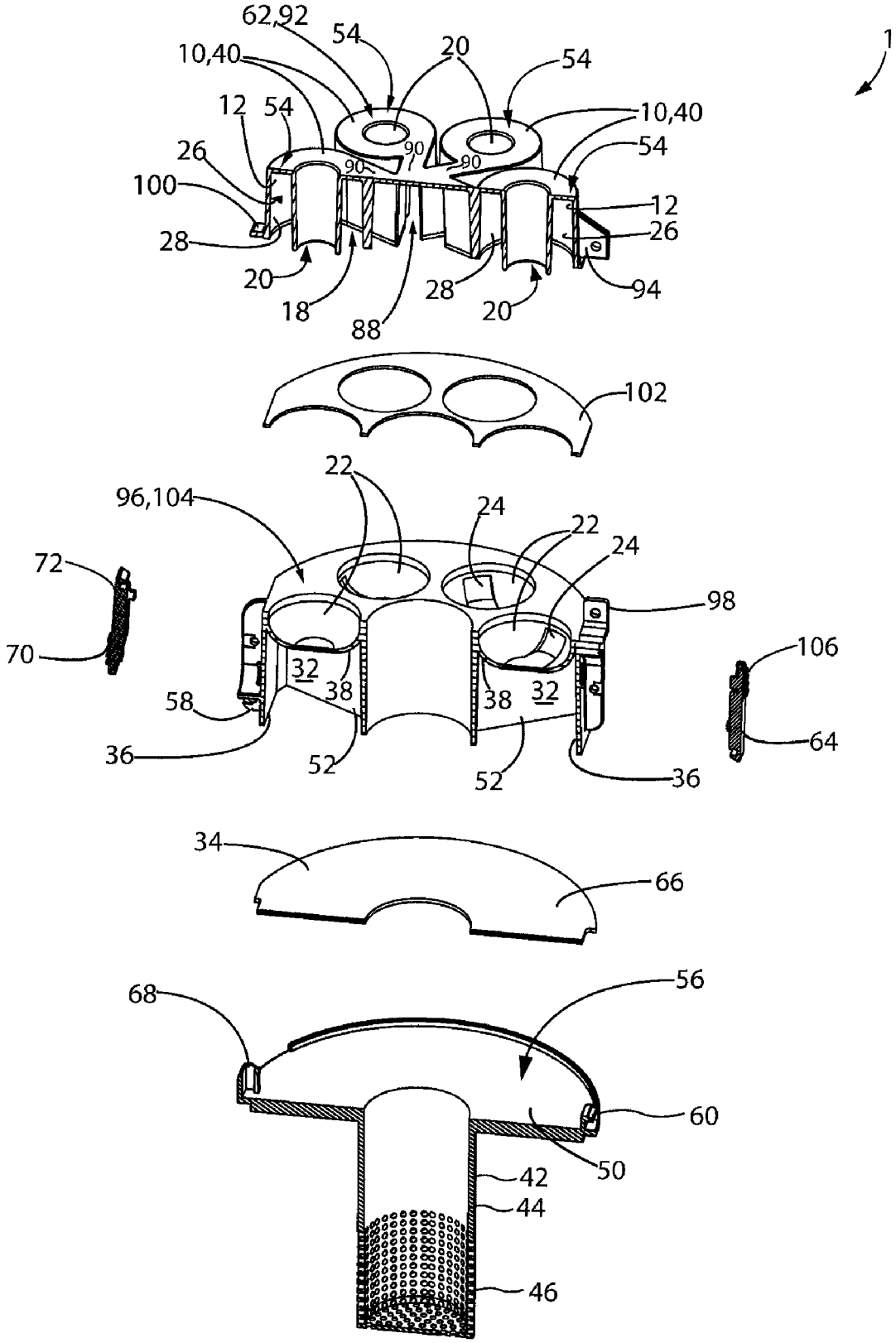
FIG. 4 is a cross section taken along line 4-4 in the exploded view of FIG. 3.
Figure 5:
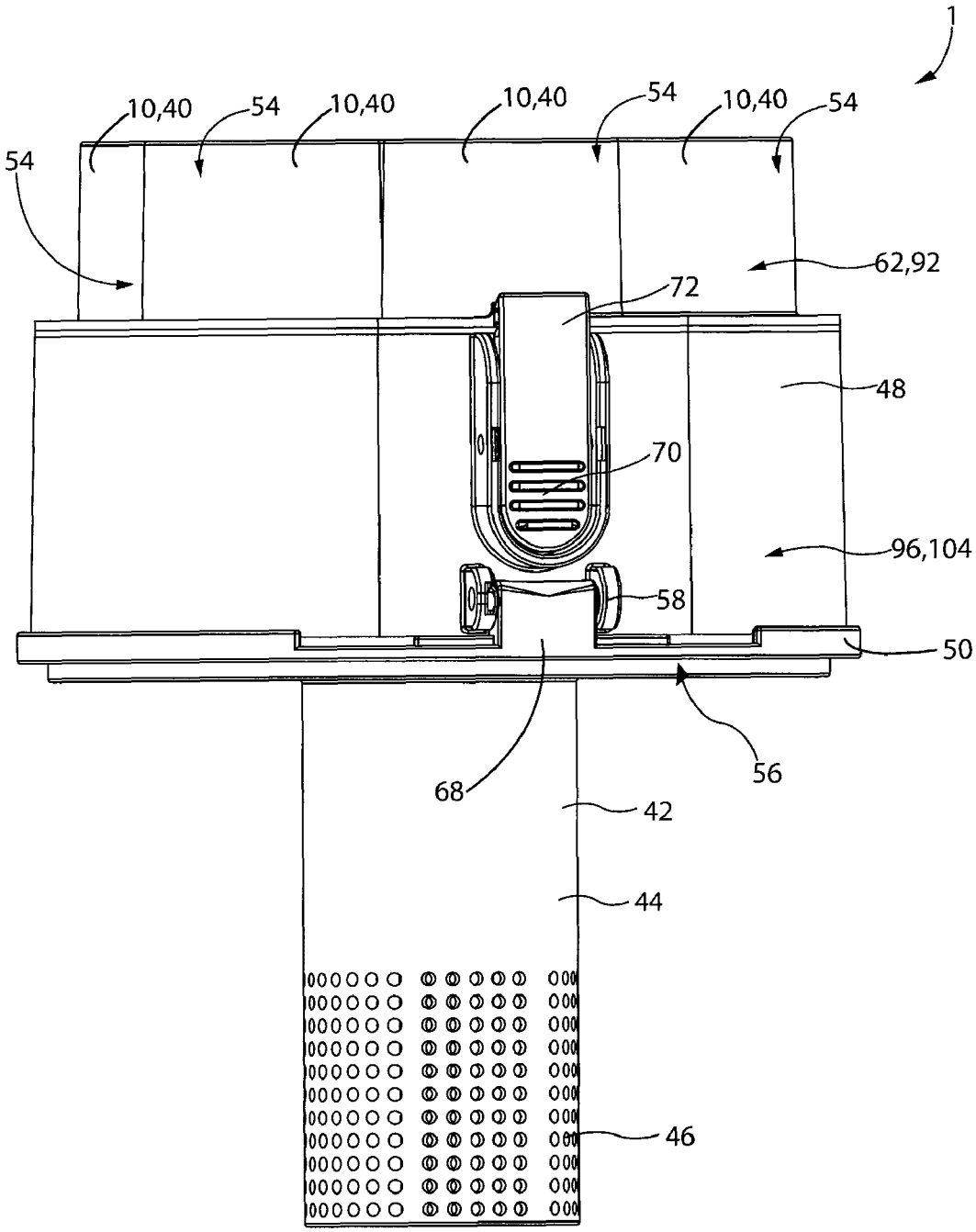
FIG. 5 is a right side view of the cyclone separator assembly of FIG. 1.
Figure 6:
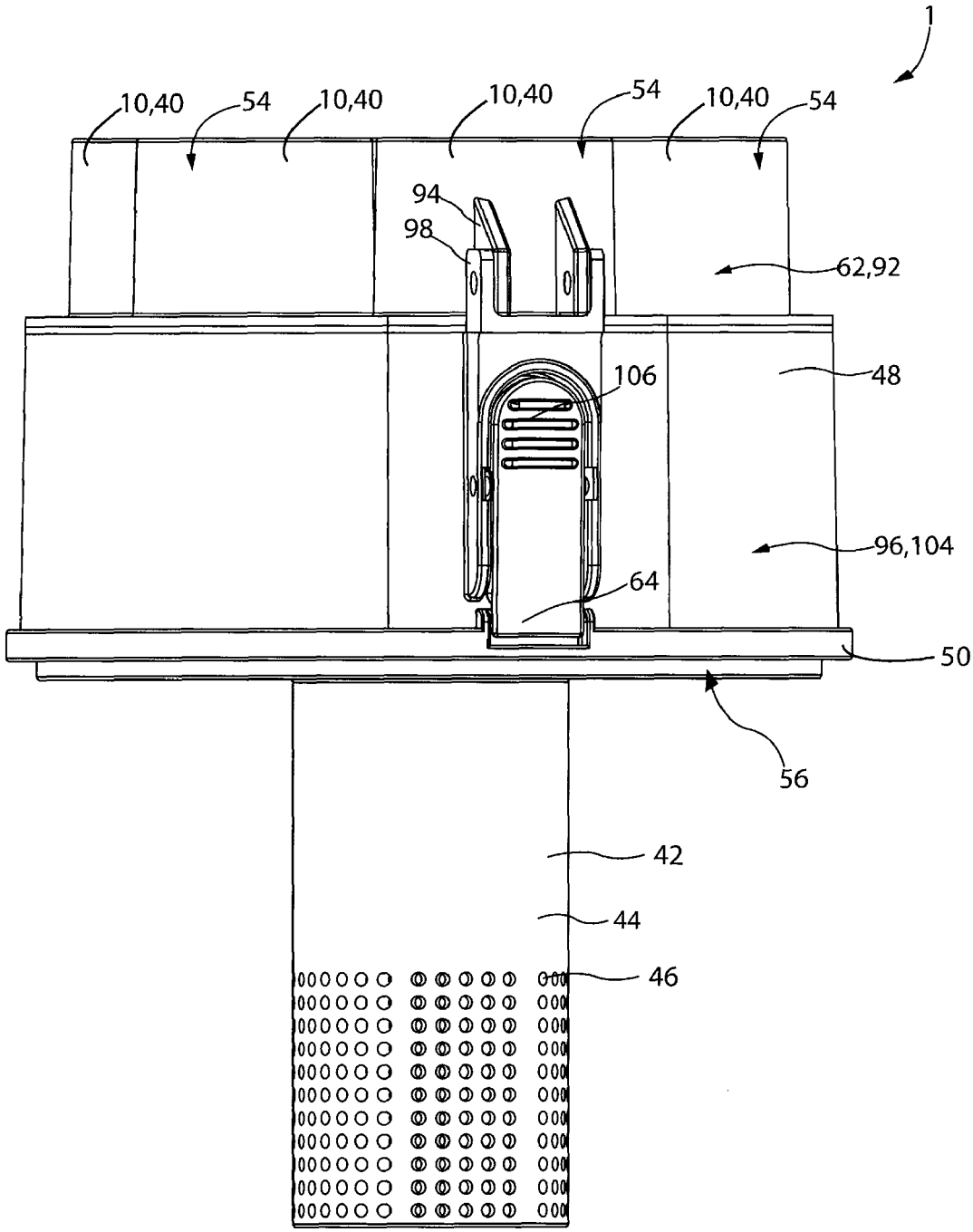
FIG. 6 is a left side view of the cyclone separator assembly of FIG. 1.
Figure 7:
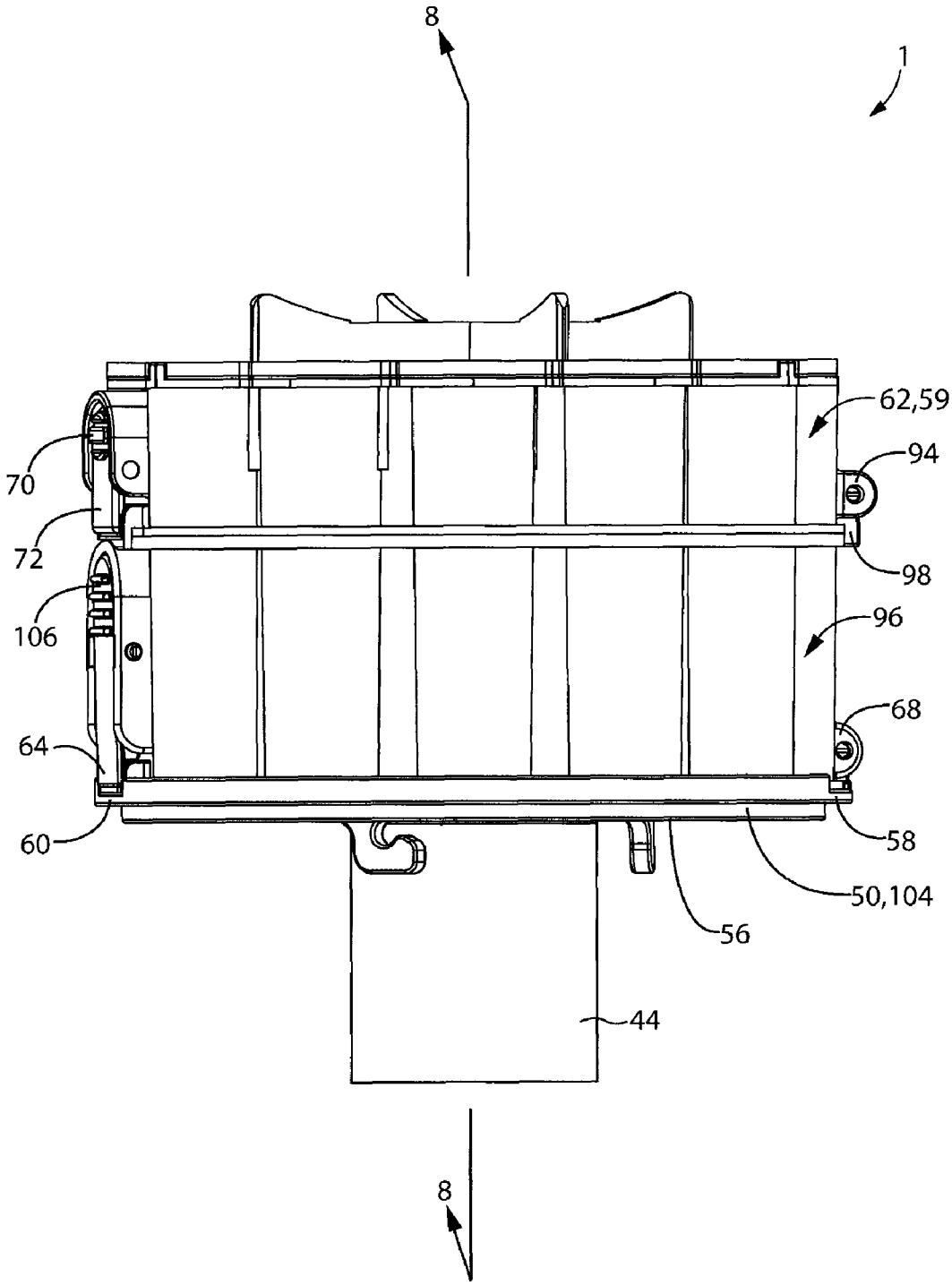
FIG. 7 is a front view of another embodiment of a cyclone separator assembly.
Figure 8:
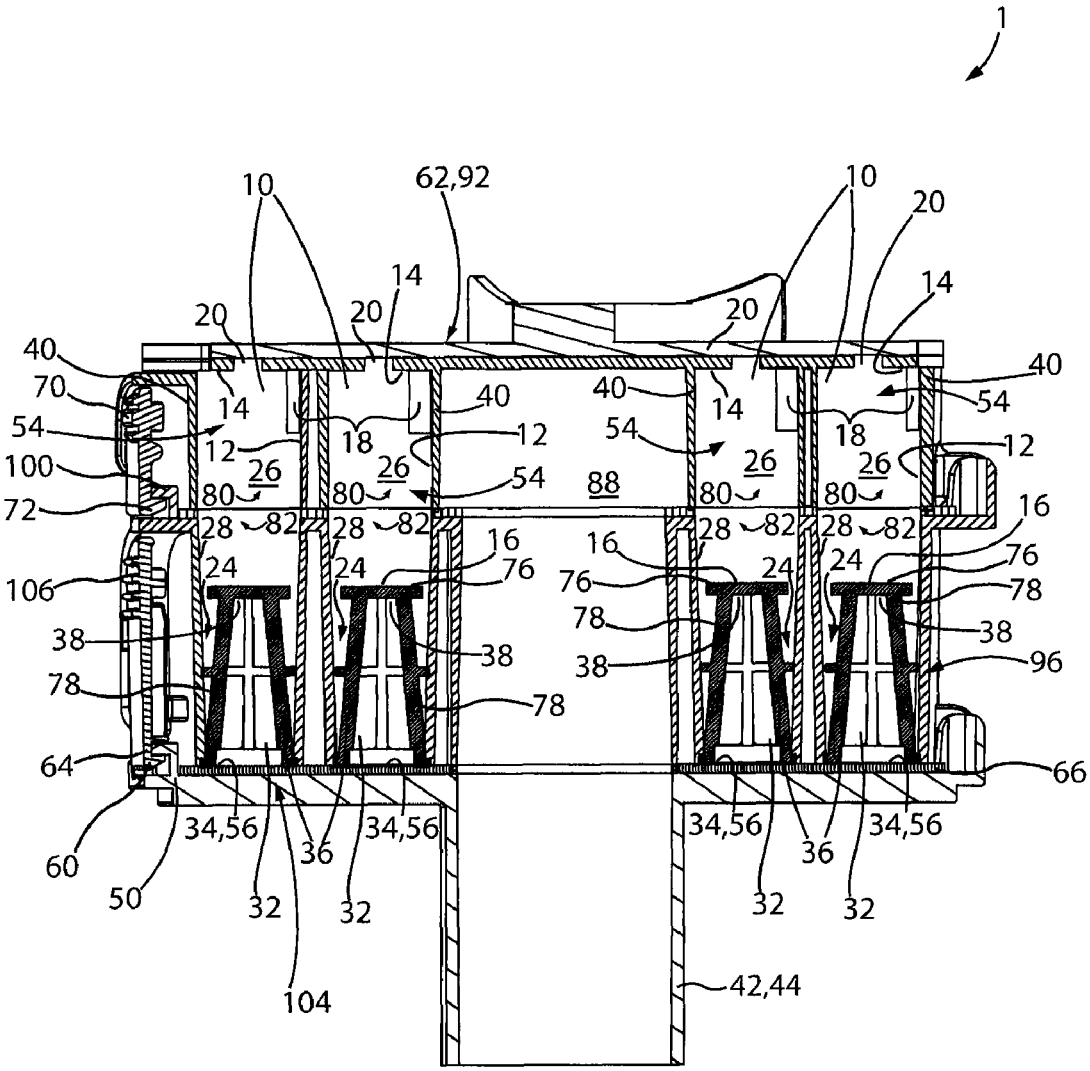
FIG. 8 is a cross section taken along line 8-8 in FIG. 7.
Figure 9:
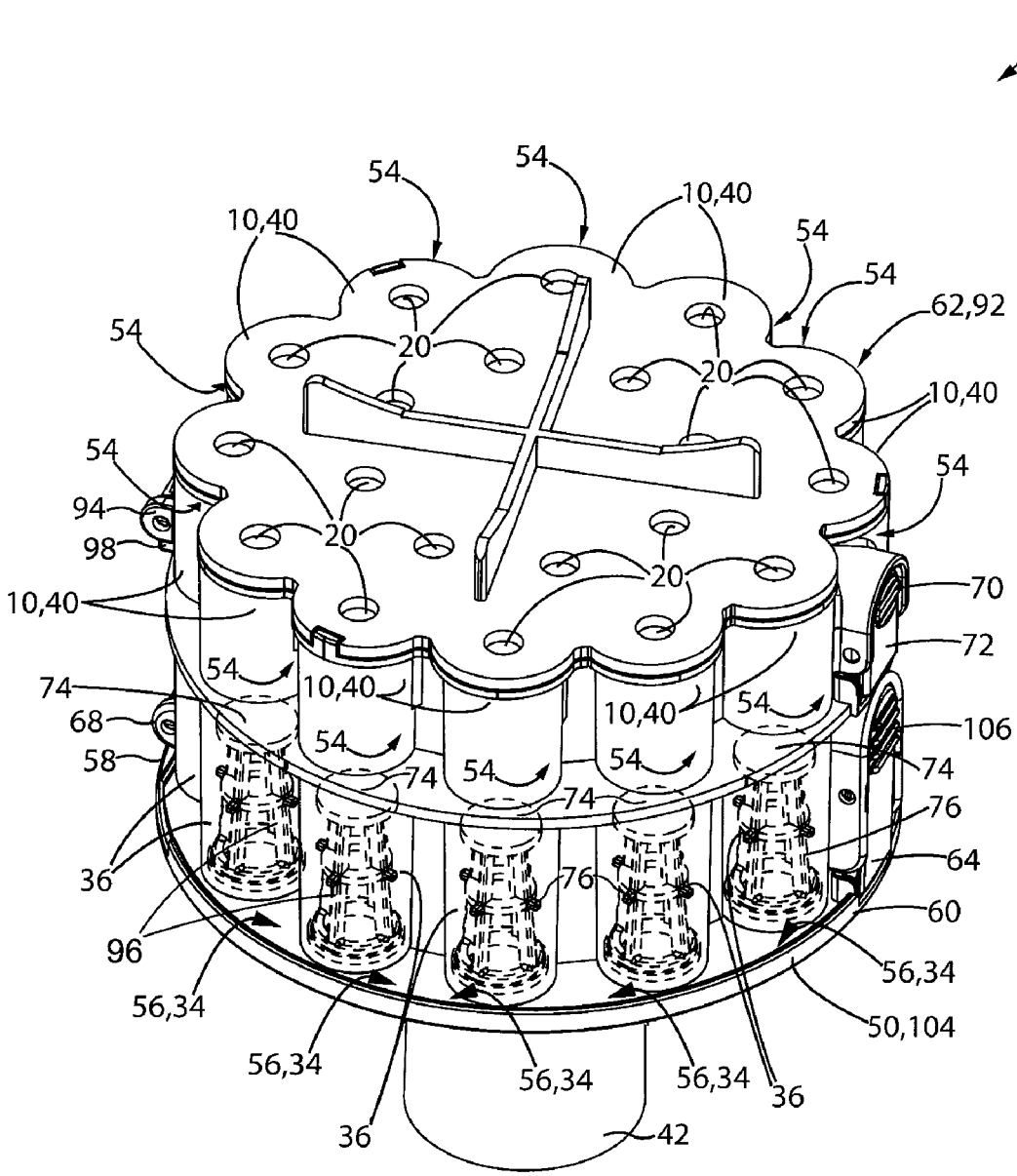
FIG. 9 is a perspective view of the cyclone separator assembly of FIG. 7, showing a separator plate and legs in dotted line.
Figure 10:
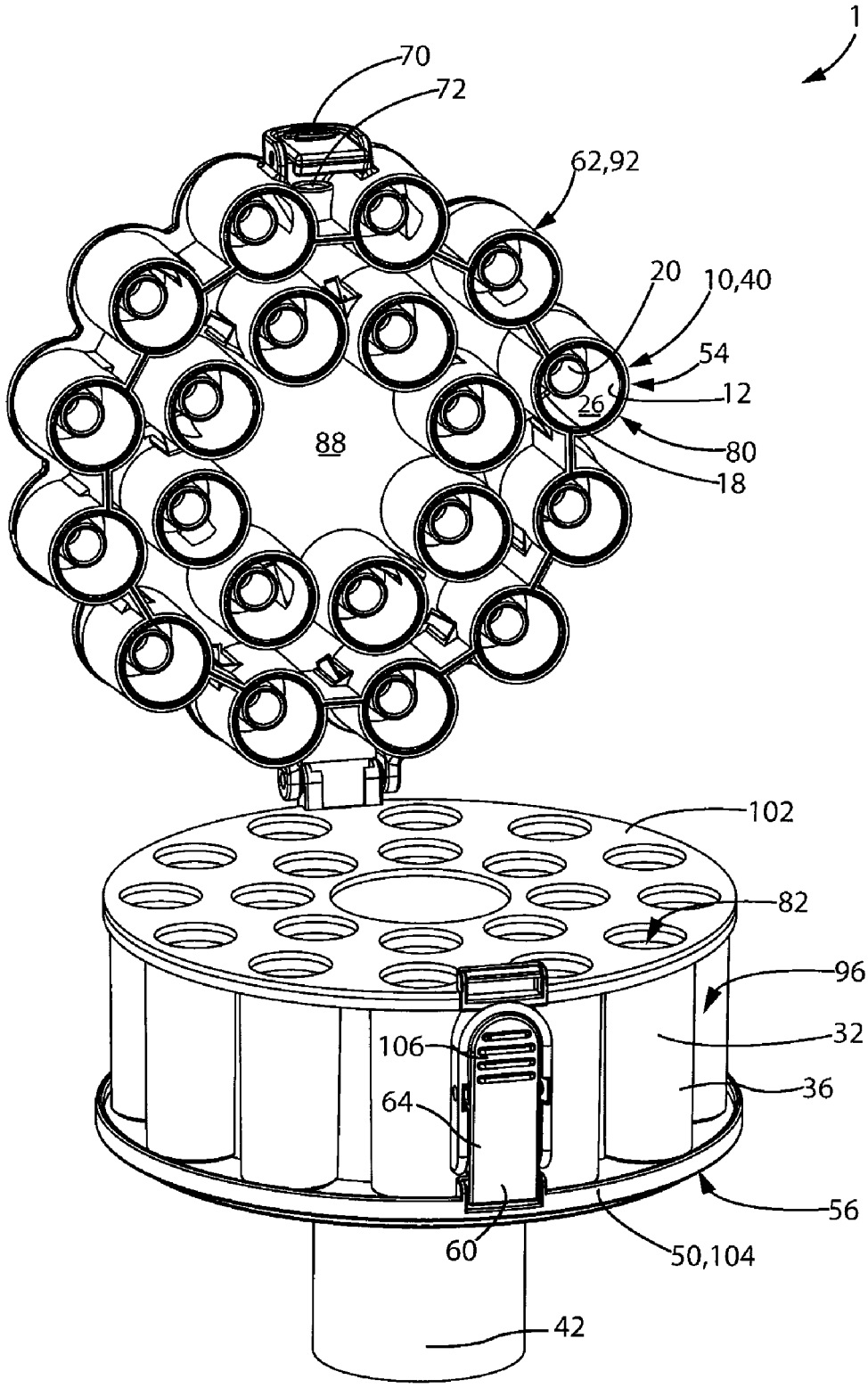
FIG. 10 is a perspective view of the cyclone separator assembly of FIG. 7, showing the cyclone chambers in an opened configuration.
Figure 11:
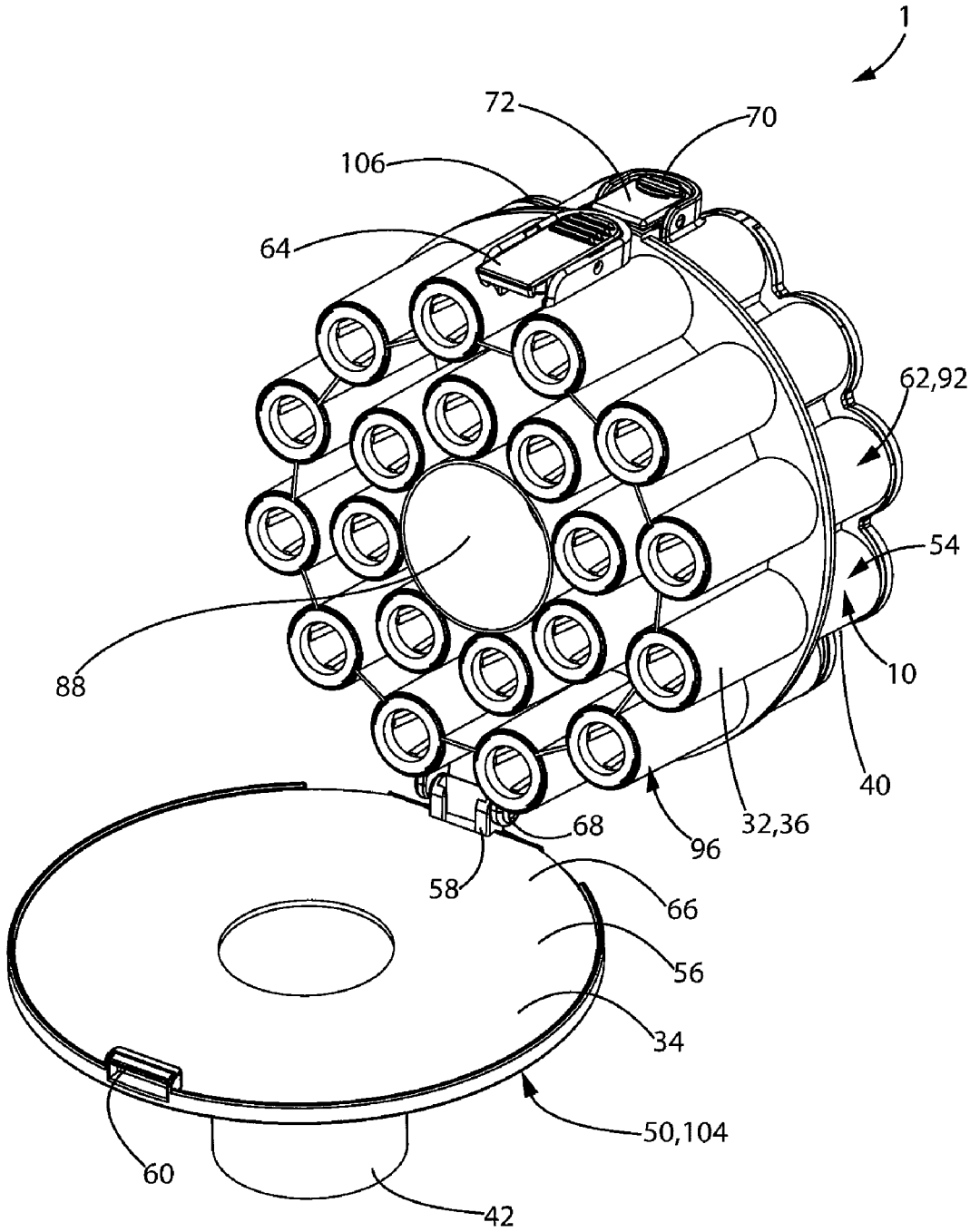
FIG. 11 is a perspective view of the cyclone separator assembly of FIG. 7, showing the dirt collection chambers in an opened configuration.
Figure 12:
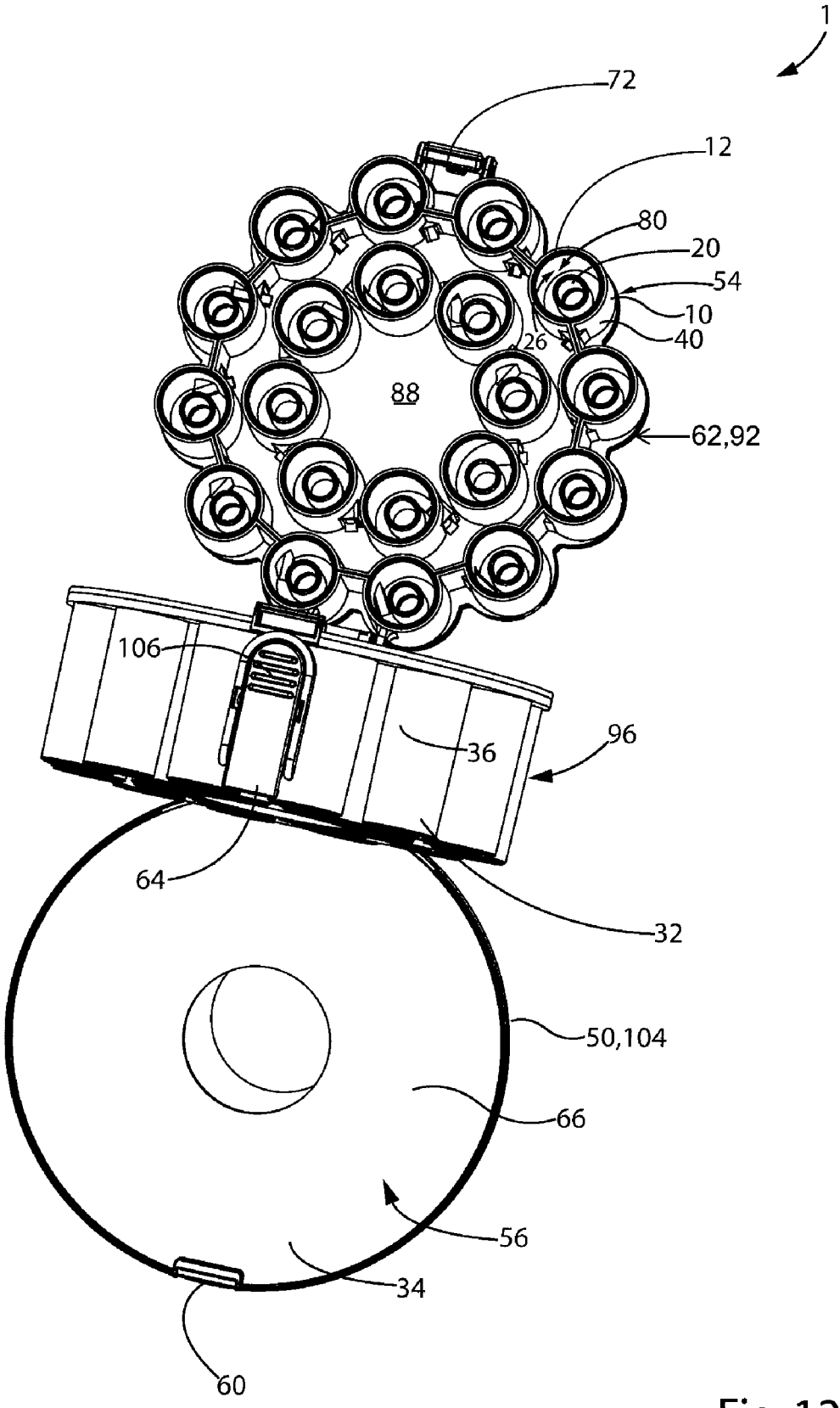
FIG. 12 is a perspective view of the cyclone separator assembly of FIG. 7, showing both the cyclone chambers and the dirt collection chambers in an opened configuration; and, FIG. 13 is a perspective view of a surface cleaning apparatus utilizing a cyclone separator assembly as setout herein.

As shown in FIG. 2, sidewalls 12 preferably extend linearly and, in the orientation shown in FIG. 2, vertically. Accordingly, but for transition members 22, the cyclones 10 are exemplified as being cylindrical. It will be appreciated that while cyclones 10 are preferably generally cylindrical, they may have other shapes. For example, they may be frustoconical as is also known in the art. In addition, air inlets 18 and air outlets 20 may be of any construction and positioning known in the art.

Figure 1:
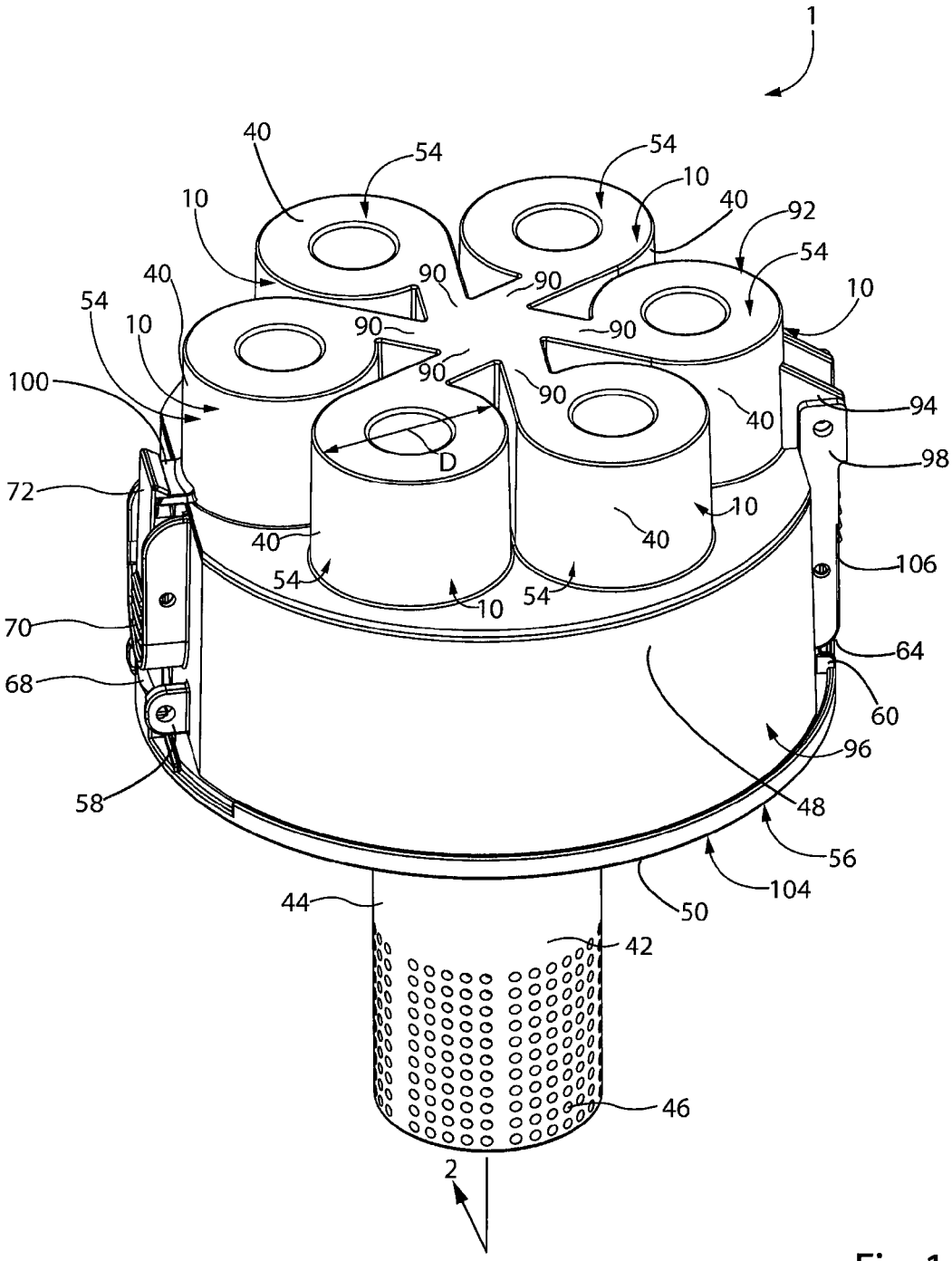
FIG. 1 is a perspective view of an embodiment of a cyclone separator assembly.

As shown in FIG. 1, each transition member 22 extends between lower end 28 of sidewall 12 and second end 16. If the cyclone separator is oriented as shown in FIG. 1 (it is in an upright orientation), then transition member 22 extends downwardly and inwardly. It will be appreciated that transition member 22 may have a variety of configurations.

In the orientation exemplified, dirt outlet (or separated material outlet) 24 is provided in a lower portion of the cyclone casing. Preferably, at least a portion of dirt outlet 24 is provided in transition member 22. For example, dirt outlet 24 may extend above transition member 22, it may extend to the juncture of transition member 22 and sidewall 12 or, it may extend to a position below the juncture of transition member 22 and sidewall 12. As exemplified in FIG. 2, it 24 may be positioned completely within transition member 22.

In alternate embodiments, as will be described further herein, a transition member 22 may not be provided, and dirt outlet 24 may be formed in another manner.

One or more dirt outlets 24 may be provided for a single cyclone chamber 26. Preferably, a single dirt outlet 24 is provided, as exemplified in FIGS. 1-6. Dirt outlet 24 may be positioned at any angular displacement with respect to inlet 18. Preferably, the one or more dirt outlets 24 is positioned at an angular displacement with respect to inlet 18 from about 90 to about 330 degrees, more preferably from about 180 to about 300 degrees, more preferably from about 240 to about 300 degrees and most preferably about 270 degrees in the flow direction around cyclone chamber 26 from air inlet 18.

As shown in FIGS. 1 and 2, each cyclone chamber has a height H (i.e., the distance between first and second opposed ends 14 and 16) and a diameter D (i.e. the diameter of sidewall 12). Height H and diameter D may be any of those known in the art. Preferably, height H is less than diameter D and, more preferably, height H is less than half of the diameter D.

It will be appreciated that transition member 22 may have any desired length. Accordingly, transition member 22 may extend from end 16 to inlet 18. However, it is preferred that a portion of sidewall 12 is provided between inlet 18 and transition member 22. Further, it is preferred that the lower end of inlet 12 is closer to second lower end 16 than first upper end 14.

A dirt collection (or separated material) chamber 32 is positioned in fluid flow communication with dirt outlet 24. Preferably, as exemplified, each cyclone separator 10 has a dirt collection chamber 32 that is isolated from (i.e., not in flow communication with) the other dirt collection chambers 32. Alternately, each cyclone separator may be in communication with a common dirt collection chamber. Further, as exemplified, it is preferred that each dirt collection chamber is axially spaced from cyclone chamber 26. Accordingly, dirt collection chamber may be positioned above or below cyclone chamber 26 along the longitudinal axis of the cyclone chamber 26.

In the embodiment of FIGS. 1-6, each dirt collection chamber 32 is positioned below a respective cyclone chamber 26 and has a collection surface 34, which is facing and spaced from the second end 16 of each cyclone chamber 26, one or more sidewalls 36 and a top wall 38. Dirt or other heavy material will exit cyclone chamber 26 via outlet 24 and accumulate on collection surface 34. As exemplified in FIG. 2, top wall 38 of dirt collection chamber 32 may be provided by transition members 22.

In the exemplified embodiment, all of the dirt collection chambers 32 except for the opening bottom are integrally formed from a lower casing 96, which comprises a circumferential wall 48, and dividers 52, which define the sidewalls each chamber 32. Further, a bottom panel 50, which is separately formed from casing 96, forms the collection surface 34 of each dirt collection chamber 32. Alternately, in some embodiments, a gasket 66 or other sealing member may seat on bottom panel 50, and may form the collection surface 34.

As exemplified in FIG. 1, cyclone separator assembly 1 may be provided as a second cyclonic stage. Accordingly, cyclone separator assembly 10 preferably has provided as part thereof the air outlet or vortex finder 42 of an upstream cyclonic stage 128 (which is preferably a single cyclone but, as will be appreciated, could be a plurality of cyclones in parallel wherein the vortex finder of each is secured to, and removable with, cyclone separator assembly 1). Preferably, vortex finder 42 comprises a tubular member having sidewalls 44 wherein apertures 46 may be provided in a lower end thereof. Alternately, it will be appreciated that any air outlet or vortex finder of a cyclone known in the art may be utilized, and need not be provided as part of cyclone separator assembly 1. Vortex finder 42 is preferably attached to the bottom of cyclone separator assembly 1, e.g., bottom panel 50, and may be molded as part of bottom panel 50.

If the cyclones are downstream from another filtration member or air treatment member, then air inlets 18 may be in airflow communication therewith by any means known in the art. As shown in the cross-section of FIG. 2, air may enter through aperture 46 into vortex finder 42 and travel outwardly to a central hub 88, which has an arm 90 extending to each cyclone 10.

As exemplified, each of the cyclone chambers 26 and each of the separated material chambers 32 are openable. Preferably, the cyclone chambers 26 are each openable by movement of a first movable portion 54 of each cyclone 10, and the dirt collection chambers 32 are each openable by movement of a second movable portion 56 of each dirt collection chamber 32. More preferably, the first movable portion 54 is separate from the second movable portion 56. That is, the first 54 and second 56 movable portions may be moved independently of each other. For example, the cyclone chambers 26 may be opened without necessarily opening the dirt collection chambers 32.

In the exemplified embodiment, the first movable portion 54 of each cyclone 10 comprises sidewall 12, first end 14, air inlet 18, and air outlet 20. That is, sidewall 12, first end 14, air inlet 18, and air outlet 20 are movable away from transition member 22, such that second end 16 is open and accessible to a user. Further, in the exemplified embodiment, as the cyclone casings are integrally formed from upper casing 92, the first movable portions 54 of each cyclone 10 forms a first common movable portion 62. Accordingly, the cyclone chambers 26 are concurrently openable. It will be appreciated that cyclone chambers 26 may open at any position along the sidewall 12 and optional transition member 22.

As exemplified, the cyclone chambers are preferably openable along a plane transverse to the longitudinal axis of the cyclone chambers 26. In FIG. 2, cyclone chambers 26 are vertically orientated and cyclone chambers open along a horizontal plane. In alternate embodiments, cyclone chambers 26 may open along another plane.

In the exemplified embodiment, upper casing 92 is pivotally mounted via flange 94 to casing 96. Casing 96 may be provided with a flange 98 to which flange 94 is attached, e.g. pivotally attached. A latch 72 is provided on casing 96, which engages a flange 100 on upper casing 92. When button 70 is pressed, latch 72 opens permitting upper casing 92 to pivot open thereby providing access to the interior of cyclone chambers 26. It will be appreciated that other opening methods may be used. For example, upper casing 92 may be slideably or translatably mounted to lower casing 96. Alternately, It will be appreciated that upper casing 92 may be removably mounted to casing 96 such as by a screw mount, a bayonet mount or securing members such as wing nuts.

A gasket 102 may be provided between upper casing 92 and lower casing 96 so as to assist in creating an airtight seal when latch 72 engages flange 100. It will be appreciated that an O-ring, or other sealing member known in the art may be used.

In case cyclone chambers 26 require emptying, button 70 of latch 72 may be pressed. Upper casing 92 may then be pivoted upwardly together with gasket 102, or alternately gasket 102 is subsequently removed or remains in position. Cyclone chambers 26 may then be inverted permitting them to be emptied.

In the exemplified embodiment, the second movable portion 56 comprises the collection surface 34 of each dirt collection chamber 32. That is, the collection surface 34 is movable away from the sidewalls 36, such that the dirt collection chambers may be emptied. Further, as the collection surfaces 34 are formed by bottom panel 50 (optionally in conjunction with gasket 66), the second movable portions 56 form a second common movable portion 104. Accordingly, the dirt collection chambers 32 are concurrently openable.

In the exemplified embodiment, bottom panel 50 is pivotally attached to casing 96. For example, flange 58 may be provided on bottom panel 50. A mating flange 68 may be affixed to casing 96, for example at circumferential wall 48. A latch 64 may be provided on circumferential wall, opposed to mating flange 68, which engages flange 60, which is provided on bottom panel 50. Accordingly, when in the closed position (shown in FIG. 1), the latch 64 may engage flange 60, thereby securing bottom panel 50 in position. When button 104 is pressed, latch 64 opens permitting bottom panel 50 to pivot open thereby opening dirt chambers 32. It will be appreciated that other opening methods may be used. For example, bottom panel 50 may be slideably or translatably mounted to lower casing 96. Alternately, It will be appreciated that bottom panel 50 may be removably mounted to casing 96 such as by a screw mount, a bayonet mount or securing members such as wing nuts.

In order to provide an airtight seal for pivoting bottom panel 50, a sealing gasket 66, O-ring or other sealing member known in the art may be provided. Gasket 66 may be mounted to, or removably mounted to, pivoting bottom 50.

It will be appreciated that not all cyclone separators 10 need be openable concurrently. For example, they may be individually openable or openable in groups. Alternately, the may be concurrently openable but not integrally formed. For example, first movable portion 54 may be individually formed and mounted to a frame such that the first movable portions 54 form a unitary part and are openable concurrently.

Referring to FIGS. 7-14, an alternate embodiment of a cyclone assembly 1 is exemplified. This embodiment is similar to the embodiment of FIGS. 1-6, and like numerals are used to refer to like elements. In this embodiment, twenty cyclones 10 are provided in parallel, and the cyclones are arranged in concentric rings (for simplicity, each cyclone, and the elements of each cyclone, have not been labeled in each figure).

In this embodiment, dirt collection chamber 32 is provided in the bottom of the cyclone casing. Accordingly, a transition member 22 is not provided in each cyclone. Rather a separator plate 76 is provided in cyclone casing to define a cyclone chamber 26 on one side and a dirt collection chamber 32 on the other side. Separator plate 76 may be supported in position by any means, such as legs 78 which extend from collection surface 34. Separator plate 76 defines the boundary between second end 16 of cyclone chamber 26, and dirt chamber 32, and the annular opening between separator plate 76 and sidewall 12 defines dirt outlet 24.

In order to empty cyclone chambers 26, a portion of the cyclone casing defining the cyclone chamber is openable. As exemplified in FIG. 8, each cyclone chamber 26 comprises an upper portion 80, and a lower portion 82. Upper casings 92, which defines the upper portions 80 of each cyclone chamber 26, are integrally formed. The cyclone chamber may be openable at any position. For example, only the top may be openable. It will be appreciated that if only first end 14 is openable, then any vortex finder or outlet 20 is preferably removable with first end 14. For example vortex finder or outlet 20 may be integrally formed with first end 14

In order to empty dirt collection chamber 32, a portion of the cyclone casing defining the dirt collection chamber 32 is openable. As exemplified in FIG. 8, lower casing 96, which defines the lower portions 82 of each cyclone chamber 26, are integrally formed with each other, as well as with each dirt collection chambers 32. Accordingly, lower casing 96 forms a portion of cyclone casings 40, and sidewalls 12. Bottom panel 50 is pivotally mounted to lower casing 96. The dirt collection chamber may be openable at any position.

In this embodiment, the first movable portion 54 of each cyclone comprises the upper portion 80 of each cyclone. Similarly to the embodiment of FIGS. 1-6, the first movable portions 54 form a common movable portion 62, which is provided by upper casing 92. Upper casing 92 is pivotally mounted to lower casing 96, in a similar manner as is described hereinabove with respect to FIGS. 1-6. However, in this embodiment, flange 100 is provided on lower casing 96, and latch 72 and button 70 are provided on upper casing 92. Accordingly, when the cyclone chambers 26 are opened, they are separated into two portions, each of which may be emptied. As exemplified, it is preferred that cyclone chambers 26 are opened at a midpoint thereof.

In this embodiment, similarly to the embodiment of FIG. 1-6, the second movable portion 56 of each cyclone comprises the dirt collection surface 34 of each cyclone 10. As the collection surfaces 34 are formed by bottom panel 50 (optionally in conjunction with gasket 66), the second movable portions 56 form a second common movable portion 104. Bottom panel 50 is pivotally mounted to lower casing 96, in a similar manner as described hereinabove with respect to FIGS. 1-6.

It will be appreciated by those skilled in the art that the cyclone separator disclosed herein may be utilized with any fluid stream (e.g. liquid and/or gas). In addition, it will be appreciated by those skilled in the art that the cyclone separator may be used in any consumer appliance and, preferably, is utilized in a surface cleaning apparatus or an air cleaner. The surface cleaning apparatus may be a vacuum cleaner, including an upright vacuum cleaner, a stick vacuum cleaner, a canister vacuum cleaner, a back pack vacuum cleaner, a strap carriable vacuum cleaner or a portable vacuum cleaner; a carpet extractor, a bare floor cleaner or the like.

It will be appreciated that any of the alternate or optional configurations or features may be used single or in any particular combination or sub-combination with other configurations or features disclosed herein.

It will be appreciated by those skilled in the art that various modifications and additions may be made in each or within the scope of the following claims. In particular, it will be appreciated the cyclones may be provided at any orientation and are preferably either inverted or in an upright orientation.

The invention claimed is:

1. A cyclone separator assembly comprising:

(a) at least one cyclone casing defining a cyclone chamber, each cyclone chamber comprising a fluid inlet, a separated material outlet, a fluid outlet and a dirt collection surface; and, (b) a separated material chamber in communication with the separated material outlet exterior to the cyclone chamber;

(c) wherein each cyclone casing comprises a first movable portion that is movable between a closed, in use position and an opened position in which the cyclone chamber is open for emptying, and the separated material chamber comprises a second movable portion that is movable between a closed, in use position and an opened position in which the separated material chamber is open for emptying.

2. The cyclone separator assembly of claim 1, wherein the at least one cyclone casing comprises a plurality of cyclone casings, each cyclone casing comprising a cyclone chamber, wherein the cyclone chambers are in parallel.

3. The cyclone separator of claim 2 wherein each cyclone chamber is in communication with a common separated material collection chamber.

4. The cyclone separator of claim 2, wherein a plurality of separated material chambers are provided, and each cyclone chamber is in communication with one of the separated material chambers.

5. The cyclone separator of claim 2, wherein each cyclone casing has a first movable portion and the first movable portions are movable as a unit.

6. The cyclone separator of claim 5, wherein the first movable portions are integrally formed.

7. The cyclone separator of claim 6, wherein a plurality of separated material chambers are provided, each separated material chamber having a second movable portion and the second movable portions are integrally formed.

8. The cyclone separator of claim 7, wherein the separated material chambers comprise a collection chamber casing and an openable end panel.

9. The cyclone separator of claim 7, wherein the first and second movable portions are mounted to the collection chamber casing.

10. The cyclone separator of claim 9 wherein the first movable portion and the second movably portion are pivotally mounted to the collection chamber casing.

11. The cyclone separator of claim 10, wherein the first movable portion comprises an upper portion of each cyclone casing, and a lower portion of each cyclone casing is formed by the collection chamber casing.

12. The cyclone separator of claim 2 wherein a plurality of separated material chambers are provided and, each cyclone chamber and each separated material chamber is pivotally openable.

13. The cyclone separator of claim 1 wherein each cyclone chamber has a first end and a spaced apart second end, and each separated material chamber has a dirt collection surface facing the second end and spaced from the second end.

14. The cyclone separator of claim 13 wherein the first movable portion comprises the first end, and the second movable portion comprises the dirt collection surface.

15. The cyclone separator of claim 14 wherein the fluid inlet is provided at the first end, and the fluid inlet comprises part of the first movable portion.

16. The cyclone separator of claim 15 wherein the fluid outlet is provided at the first end, and the fluid outlet comprises part of the first movable portion.

17. The cyclone separator of claim 15 wherein the separated material outlet is provided at the second end.

18. The cyclone separator of claim 15, wherein a sidewall extends between the first end and the second end of at least one cyclone casing, and the first movable portion further comprises at least a portion of the sidewall.

19. A surface cleaning apparatus comprising the cyclone separator of claim 1.

20. The surface cleaning apparatus of claim 19 wherein, the cyclone separator comprises a second cyclonic cleaning stage of the surface cleaning apparatus.

21. The surface cleaning apparatus of claim 20 wherein, a plurality of the cyclone separators are connected in parallel to provide the second cyclonic cleaning stage.

22. The surface cleaning apparatus of claim 1 wherein the separated material chamber is adjacent the at least one cyclone casing.

23. The surface cleaning apparatus of claim 1 wherein the first portion comprises the dirt collection surface of the cyclone chamber and the second portion comprises a dirt collection surface of the separated material chamber.

24. The surface cleaning apparatus of claim 1 wherein the first portion comprises all of the dirt collection surface of the cyclone chamber and the second portion comprises all of a dirt collection surface of the separated material chamber.

* * * * *